United States Patent [19]

Todd, III et al.

[11] 4,237,944

[45] Dec. 9, 1980

[54] METHOD FOR FORMING THE NECK OF A GUITAR

[75] Inventors: Charles H. Todd, III; Hartley D. Peavey, both of Meridian, Miss.

[73] Assignee: Peavey Electronics Corporation, Meridan, Miss.

[21] Appl. No.: 870,077

[22] Filed: Jan. 17, 1978

[51] Int. Cl.[3] ..... B27M 1/08

[52] U.S. Cl. ..... 144/316; 84/293; 144/318

[58] Field of Search ..... 84/291, 293; 144/309 R, 144/313, 314 R, 315 R, 316, 318, 319; 29/445

[56] References Cited

U.S. PATENT DOCUMENTS

| | | | |
|---|---|---|---|
| 1,596,763 | 8/1976 | Place, Jr. | 84/293 |
| 3,416,399 | 12/1968 | Baldoni | 84/293 |
| 3,474,697 | 10/1969 | Kaman | 84/293 |
| 4,074,606 | 2/1978 | Fender | 84/293 |
| 4,084,476 | 4/1978 | Rickard | 84/293 |

FOREIGN PATENT DOCUMENTS

| | | | |
|---|---|---|---|
| 870182 | 2/1953 | Fed. Rep. of Germany | 144/318 |
| 980808 | 5/1951 | France | 144/318 |

*Primary Examiner*—W. Donald Bray

*Attorney, Agent, or Firm*—Victor J. Evans & Co.

[57] ABSTRACT

Disclosed herein is a method and its associated article for forming the neck of a guitar so that a torsion rod disposed within the neck can serve to straighten neck or counteract the tension or bowing effect of guitar strings. The method includes taking two similarly shaped blanks of stock material and routing a center portion complementarily formed to accommodate a torsion rod. Each element of stock material is routed to provide a mirror image of each other and dowel means are essentially disposed to provide further support for the two halves of stock material when they are joined together as by glueing. The terminal longitudinal extent of each of the stock articles is provided with means for retaining the thus assembled stock article for subsequent carving.

7 Claims, 6 Drawing Figures

METHOD FOR FORMING THE NECK OF A GUITAR

BACKGROUND OF THE INVENTION

1. Field of the Invention

Adjustable torsion rods have traditionally been disposed within guitar necks by first carving the neck to the finished configuration, and then adding the torsion rod by milling, drilling and inserting the rod. This results in an open groove which then has to be filled in. In order to provide a pleasing finished appearance, the unsightly filled groove and groove plug disposed at the end of the neck has to be provided with an overlay or finger board to obscure the scarred area from view. This is a costly inefficient and unsightly way to accomplish having a guitar neck which has an adjustable tension mechanism, and although the following discussion will be directed to guitars per se, any other string instrument can benefit from the following technique.

2. Summary of the Invention

In order to overcome the inordinate amount of time required to mill, drill and insert a rod according to the manner described hereinabove, the following technique has the advantage that it can be performed more economically than the traditional method, and provides a finished product which is aesthetically pleasing.

Accordingly it is an object of this invention to provide a method of constructing a guitar neck which requires less time than prior art methods.

It is another object of this invention to provide a method for forming a guitar neck with a concomitant decrease in manufacturing cost.

A further object of this invention contemplates providing a guitar neck whose finished appearance is basically more pleasing than configurations developed by a prior art method.

Other objects and advantages will become apparent in the following specification when considered in light of the attached drawings.

DESCRIPTION OF THE PREFERRED EMBODIMENT

Figure 1:
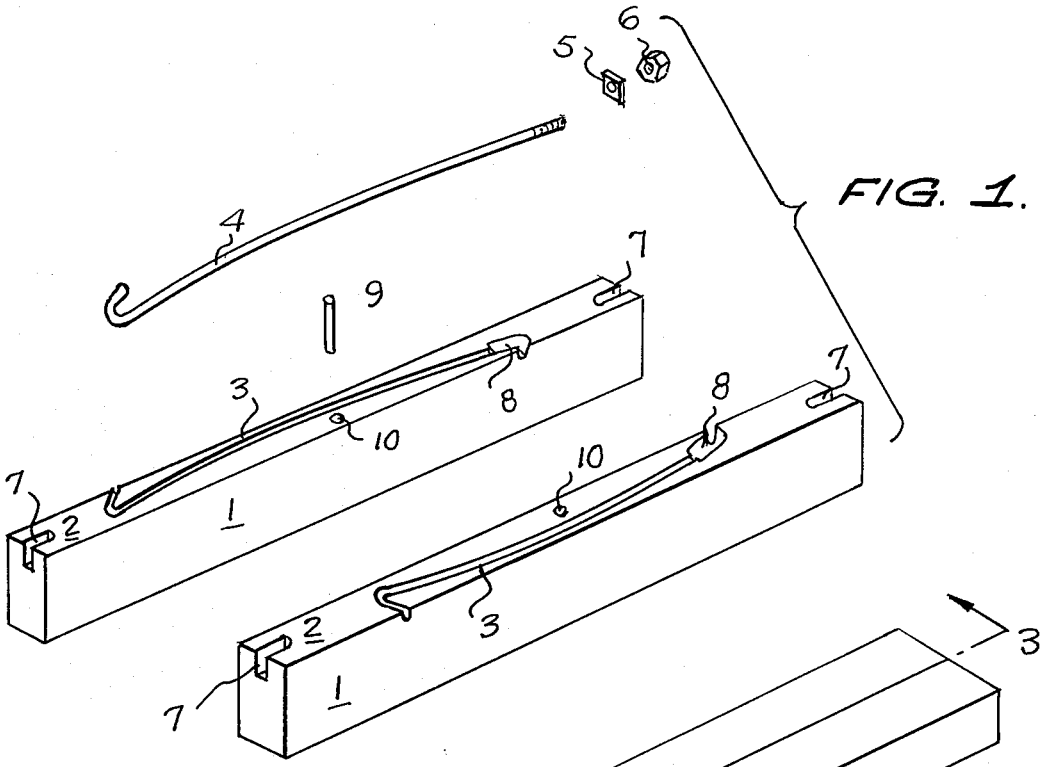
FIG. 1 shows the elements associated with a pair of stock articles used in the method according to the present invention.
Figure 2:
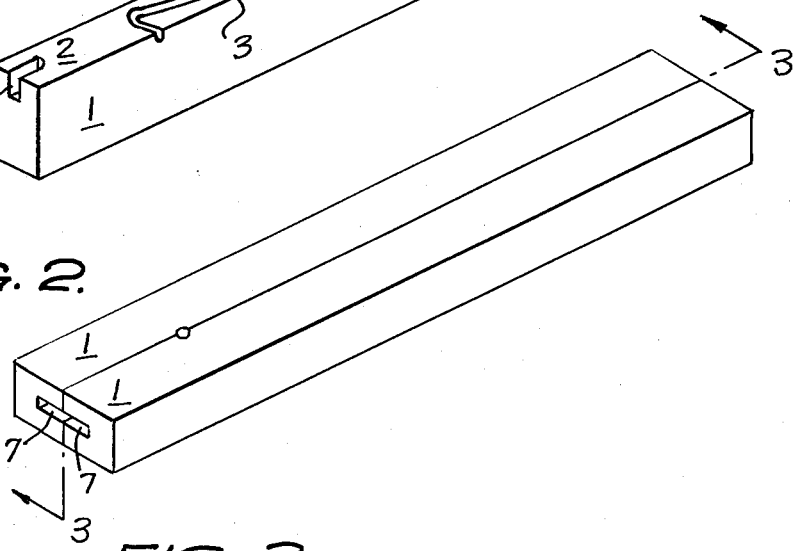
FIG. 2 shows the elements of FIG. 1 in an assembled state.

Referring to the drawings, wherein like reference numerals refer to like parts throughout, reference numeral 1 generally denotes the symmetrical pieces or blanks of stock material used in this operation. Each of these blanks of stock material have faces 2 which are to be placed in registry with one another to form a stock article after the following operation has been completed. Disposed on each face is a groove 3 which is generally J-shaped but has an arcuate leg running from the hook portion of the J. This groove denoted by numeral 3 is formed preferably by routing. The configuration of this groove is such that it will accommodate a torsion rod denoted by numeral 4 which has a hook at one extremity adapted to fit within the hook portion of the groove disposed on each blank 1 of stock material, and at its other extremity remote from the hook the torsion rod 4 is provided with a threaded end. Associated with this threaded end is a washer 5 and a nut 6. FIG. 1 shows that the longitudinal extremities of each blank of stock material is provided with a rectangular cut denoted by numeral 7 which is provided so that when the stock article is to be carved the slots 7 form a rectangular recess which engages drive means (not shown) for rotating the stock article for the carving operation. Of course, any conventional drive such as lathe, dogs, pointed dowel pins can be used in their stead. It is to be noted that the terminal portion of the groove 3 which is to register with the washer and nut 5 and 6 has a greater extent than that of the center portion of groove 3 so as to accommodate the additional dimension necessitated by washers and nuts 5 and 6. Also provided on the inner face 2 of each of the blanks 1 of stock material are holes 10 into which a dowel pin 9 is to be inserted so as to provide additional retention between the two inner faces 2.

Figure 3:
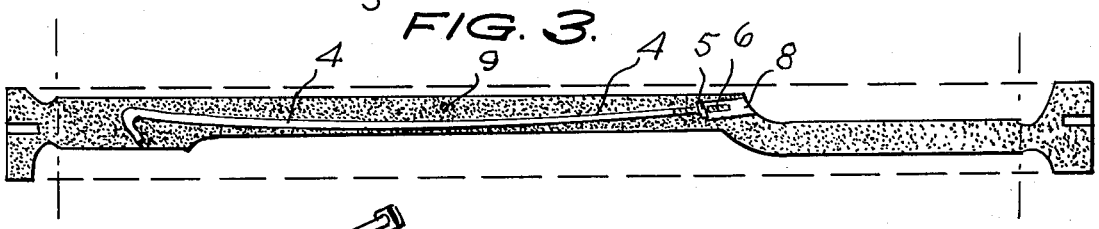
FIG. 3 is a sectional view taken along lines 3—3 of FIG. 2 having a shaded portion which indicates the final configuration of the guitar neck after carving.

FIG. 3 shows the assembled stock article in which the shaded area denotes the material that would remain after the carving operation. It is to be noted that the cut away portion denoted by numeral 8 is now accessible for adjusting purposes of the torsion rod 4 and this adjustment will serve to counteract the tension of the guitar strings against the neck.

Figure 4:
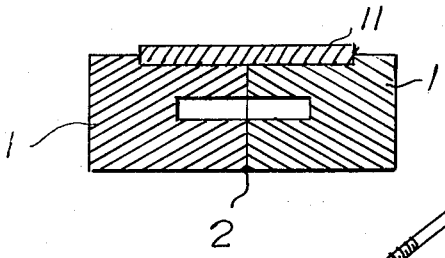
FIG. 4 shows an end view of a neck blank having optional finger board inlaid in the blank.

FIG. 4 shows the two halves of the blanks 1 of stock material assembled in faces to face relationship along face 2 and is further provided with an optional fingerboard piece which is inlaid into the stock article at the appropriate depth to insure proper location of the fingerboard after the carving operation.

Figure 5:
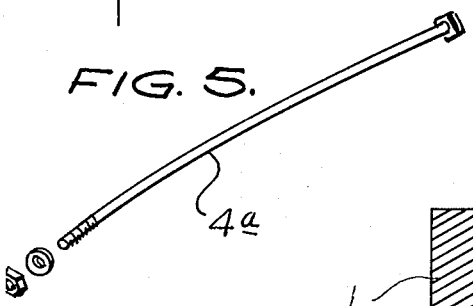
FIG. 5 shows an alternative to the torsion rod of FIG. 1.
Figure 6:
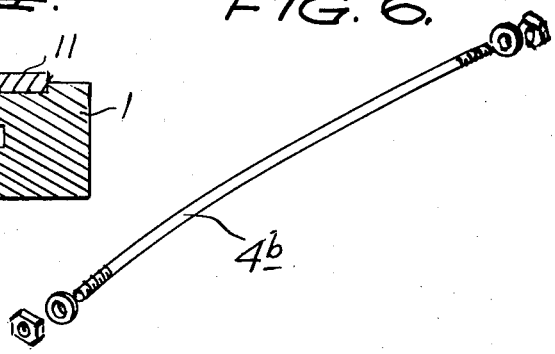
FIG. 6 shows another alternative to the torsion rods of FIGS. 1 and 5.

FIGS. 5 and 6 show an alternative embodiment for the J-shaped torsion rod, it being understood that the groove 3 would have a complemental configuration. In FIG. 5 the torsion rod **4*a* has a cold formed head at one extremity, a bowed medial portion and a threaded extremity opposite from the cold formed head. FIG. 6 is similar but the bowed medial extent of the torsion rod 4*b*** terminates in threaded portions which receive powdered metal washers and brass nuts.

It is to be noted that whereas in prior art devices an unsightly groove normally exists where in its stead according to the present invention a very minor seam is the only evidence that a torsion rod is contained within the guitar neck.

The method for achieving the assembly of this guitar neck can now be explained: first the stock articles are provided with means at the extremities to provide a gripping perch for the carving operation. Then the inner faces of each stock article are routed to have a configuration complemental to the torsion rod 4. Accommodations are made at the extremity of the torsion rod as at 8 to permit clearance for the washer and nut 5 and 6. A hole is drilled on each inner face 2 to accommodate the insertion of a dowel pin therein, and although a nut and bolt has been depicted, any conventional anchor at the end of the torsion rod can be used such as any fastening device which is well known in the art. Next the torsion rod is coated with a sealer such as wax to prevent the torsion rod 4 from binding when the two faces 2 of the stock material are glued together. The dowel pin is then inserted and the innerfaces of both blanks are coated with glue, the torsion rod 4 disposed in the grooves provided for it, and the two blanks 1 are clamped together to allow the adhesive disposed on the innerfaces to cure. Subsequently the assembled blank article is then carved to provide a guitar neck configuration. If it is desired to have a fingerboard inlaid such as the depiction shown in FIG. 4, a groove is cut on the top face of the stock article and the fingerboard is fastened thereon. The carving operation can then start and since the fingerboard has already been installed there is no likelihood that a poor finish or fit will occur. After the carving operation, the ends that are provided with the driving means are then cut off and the resulting structure is a finished guitar neck.

Having thus described the preferred embodiment of the invention it should be understood that numerous structural modifications and adaptations may be resorted to without departing from the spirit of the invention.

What is claimed is:

1. A method for assembling a guitar neck comprising: providing a pair of symmetrical uncarved blanks from which a guitar neck is to be curved, said blanks having inner and outer faces thereon respectively, routing a groove on each of said inner faces of each blank in a complementally associated relationship, disposing a torsion rod having extremities within one of said grooves, fastening together the inner faces of each blank one to the other with fastening means to form a stock article having said torsion rod disposed internally within said grooves, and carving said stock article to the configuration of a guitar neck.

2. The method of claim 1 further including coating the torsion rod with a sealer prior to its insertion in the routed groove so as to isolate said torsion rod from the fastening means which are used along the inner faces of said blanks.

3. The method of claim 1 further including the step of drilling a hole in a corresponding location in each inner face of each blank, and inserting a dowel pin therein to provide additional retention and orientation of said blanks upon assembly.

4. The method of claim 1 in which a further step includes placing anchoring means on one extremity of said torsion rod.

5. The method of claim 1 wherein said fastening is carried out by applying glue on said inner faces of each of said blanks.

6. The method of claim 1 further including forming a longitudinally extending groove on one face of said stock article and mounting a fingerboard in said groove prior to said carving operation.

7. The method of claim 1 including the further steps of providing complementary slots in the corresponding ends of each of said blanks whereby the stock article is provided with a hole in each end for accommodating an associated drive means for said carving operation and cutting off the said ends having the holes at the opposed logitudinal extent after the carving operation.

* * * * *